US007478996B2

(12) United States Patent
Kang et al.

(10) Patent No.: US 7,478,996 B2
(45) Date of Patent: Jan. 20, 2009

(54) RECIPROCATING COMPRESSOR HAVING ASSEMBLY STRUCTURE OF SUCTION MUFFLER

(75) Inventors: Yang-Jun Kang, Masan (KR); Jang-Whan Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 737 days.

(21) Appl. No.: 11/023,465

(22) Filed: Dec. 29, 2004

(65) Prior Publication Data

US 2005/0142002 A1 Jun. 30, 2005

(30) Foreign Application Priority Data

Dec. 31, 2003 (KR) ..... 10-2003-0102305

(51) Int. Cl.
*F04B 39/00* (2006.01)
*F02M 35/00* (2006.01)
*F01N 1/08* (2006.01)

(52) U.S. Cl. ..... 417/312; 417/417; 181/229; 181/264

(58) Field of Classification Search ..... 417/312, 417/417; 181/227, 229, 243, 264, 403
See application file for complete search history.

(56) References Cited

U.S. PATENT DOCUMENTS 1,081,348 A * 12/1913 Unke et al. ..... 181/264
1,580,347 A * 4/1926 Tagtmeyer ..... 181/264
1,752,038 A * 3/1930 Sunday ..... 181/264
1,810,252 A * 6/1931 Noonan ..... 181/264
1,822,990 A * 9/1931 Gorsline ..... 181/264
6,860,725 B2 * 3/2005 Park et al. ..... 417/312
7,306,438 B2 * 12/2007 Kang et al. ..... 417/417

FOREIGN PATENT DOCUMENTS

| | | | |
|---|---|---|---|
| JP | 358202321 A | * | 11/1983 |
| JP | 7-189945 A | | 7/1995 |
| JP | 7-301186 A | | 11/1995 |
| JP | 8-210278 A | | 8/1996 |
| JP | 3073018 B2 | | 6/2000 |
| JP | 2002-54562 A | | 2/2002 |
| JP | 2002-147873 A | | 5/2002 |
| JP | 2003-512581 A | | 4/2003 |
| KR | 1999-0016825 U | | 5/1999 |

* cited by examiner

*Primary Examiner*—Charles G Freay
(74) *Attorney, Agent, or Firm*—Birch, Stewart, Kolasch & Birch, LLP

(57) ABSTRACT

Disclosed is a reciprocating compressor having an assembly structure of a suction muffler, in which a supporting unit is formed on an inner circumferential surface of a resonant container of the suction muffler and a baffle is assembled in the resonant container by the supporting unit. By forming protrusions in the resonant container and inserting a baffle between the protrusions, the suction muffler can be easily and simply assembled. Accordingly, production costs can not only be reduced but also an increased noise reduction effect is obtained by precisely regulating an assembly position.

8 Claims, 5 Drawing Sheets

RECIPROCATING COMPRESSOR HAVING ASSEMBLY STRUCTURE OF SUCTION MUFFLER

BACKGROUND OF THE INVENTION

1. Field of the Invention

The present invention relates to a reciprocating compressor, and more particularly, to a reciprocating compressor having an assembly structure of a suction muffler, in which a baffle can be firmly assembled in a resonant container of the suction muffler.

2. Description of the Background Art

In general, a reciprocating compressor refers to a compressor in which a piston sucks, compresses and discharges a gas, linearly reciprocating in a cylinder.

FIG. 1 is a longitudinal sectional view showing the conventional reciprocating compressor.

As shown therein, the conventional reciprocating compressor 1 includes: a casing 10 for communicating a gas suction pipe (SP) with a gas discharge pipe (DP); a frame unit 20 elastically installed in the casing 10; a reciprocating motor 30 supported by the frame unit 20 and installed in the casing 10; a compression unit 40 connected to the reciprocating motor 30 and supported by the frame unit 20; and a resonance spring unit 50 for inducing the resonance movement so as to elastically support the reciprocating motor 30.

The frame unit 20 includes: a front frame 21 for supporting both one side of the reciprocating motor 30 and the compression unit 40; a middle frame 22 coupled with the front frame 21 and supporting the other side of the reciprocating motor 30; and a rear frame 23 coupled with the middle frame 22 and supporting a rear resonance spring 53 to be described later.

The reciprocating motor 30 includes: an outer stator 31 fixedly installed between the front frame 21 and the middle frame 22; an inner stator 32 fixed to the front frame 21, leaving a certain air gap at the inside of the outer stator 31; and a mover 33 interposed between the outer stator 31 and the inner stator 32, coupled with a piston 42 of the compression unit 40, and linearly reciprocating together with the piston 42.

The compression unit 40 includes: a cylinder 41 fixed to the front frame 21; the piston 42 slidingly inserted into the cylinder 41, coupled with the mover 33 of the reciprocating motor 30 and linearly reciprocating; a suction valve 43 formed at a front end surface of the piston 42 and opening or closing a suction flow channel (F); a discharge valve 44 formed at a discharge side of the cylinder 41 and controlling the discharge of a compressed gas by opening or closing a compression space (P); a valve spring 45 for elastically supporting the discharge valve 44; and a discharge cover 46 accommodating the discharge valve 44 and the valve spring 45 and covering the discharge side of the cylinder 41.

The resonance spring unit 50 includes: a spring supporting unit 51 coupled with a connection portion of the mover 33 and the piston 42; and a front resonance spring 52 and a rear resonance spring 53 disposed at front and rear both sides of the spring supporting unit 51 and elastically supporting the mover 33 and the piston 42.

Meanwhile, as shown in FIG. 2, a suction muffler 60 is mounted at a rear end of the piston 42 such that the suction muffler 60 is concentrically rear end of the piston 42 such that the suction muffler 60 is concentrically positioned with the gas suction pipe (SP, refer to FIG. 1).

The suction muffler 60 includes: a guide pipe 61 inserted into the suction flow channel (F, refer to FIG. 1) of the piston 42 and provided with its end closely fixed to a rear surface of the piston 42; a resonant container 62 communicated with the guide pipe 61, expanded and having a resonant space (V); and a baffle 63 coupled in the middle of the resonant container 62 and dividing the resonant space (V) into right and left.

The resonant container 62 is formed as a cylindrical shape and provided with one side which is completely opened and the other side of which center is partially opened.

The baffle 63 is erected in the middle of the resonant space (V) and then welded thereat, a through hole 63*a* is formed in the middle of the baffle 63, and therefore the baffle 63 makes a ring shape as a whole.

Undescribed reference marks LP, D and P stand for a loop pipe, a discharge space and a compression space, respectively.

The conventional reciprocating motor operates as follows.

When the power is applied to the outer stator 31 of the reciprocating motor 30, a flux is formed between the outer stator 31 and the inner stator 32. Both the mover 33 and the piston 42 move horizontally according to a direction of the flux and linearly reciprocate by the resonance spring unit 50 to generate pressure difference in the compression space (P), thereby sucking a refrigerant gas, compressing the refrigerant gas at a certain pressure and discharging the compressed refrigerant. A series of processes are repeated. At this time, when the suction valve 43 is opened or closed, it collides with the piston 42, making a suction noise. However, such a suction noise flows into the resonant container 62 through the guide pipe 61 of the suction muffler 60 and is offset by the Helmholtz's effective.

However, in case of the conventional reciprocating compressor having such construction, when the baffle is assembled in the resonant container of the suction muffler, since a separate structure by which the baffle is perpendicularly supported is not formed in the resonant container, it is hard to assemble the baffle at an exact position of an inner circumferential surface of the resonant container, thereby lowering operability. In addition to this, since the baffle cannot be assembled at the exact position of the inner circumferential surface of the resonant container, a noise reduction effect is reduced.

SUMMARY OF THE INVENTION

Therefore, an object of the present invention is to provide a reciprocating compressor having an assembly structure of a suction muffler capable of easily and firmly assembling a baffle at a precise position of a resonant container of the suction muffler.

Another object of the present invention is to provide a reciprocating compressor having an assembly structure of a suction muffler capable of increasing productivity and improving a noise reduction effect by assembling a baffle at a precise position of a resonant container.

To achieve these and other advantages and in accordance with the purpose of the present invention, as embodied and broadly described herein, there is provided a reciprocating compressor having an assembly structure of a suction muffler, comprising: a casing for connecting a gas suction pipe with a gas discharge pipe; a frame elastically installed in the casing; a reciprocating motor supported by the frame; a piston coupled with a mover of the reciprocating motor and compressing a refrigerant gas while linearly reciprocating in a cylinder; a suction valve for opening or closing a suction flow channel of the piston; a discharge valve for opening or closing a discharge side of the cylinder; a plurality of resonance springs for elastically supporting the piston in a direction of motion and inducing the resonance movement; and a suction muffler coupled with the piston and guiding the refrigerant gas to the suction flow channel of the piston and simultaneously muffling a suction noise generated when opening or closing the suction valve, wherein a supporting unit is fonned on an inner circumferential surface of a resonant container of the suction muffler and a baffle is assembled in the resonant container by the supporting unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
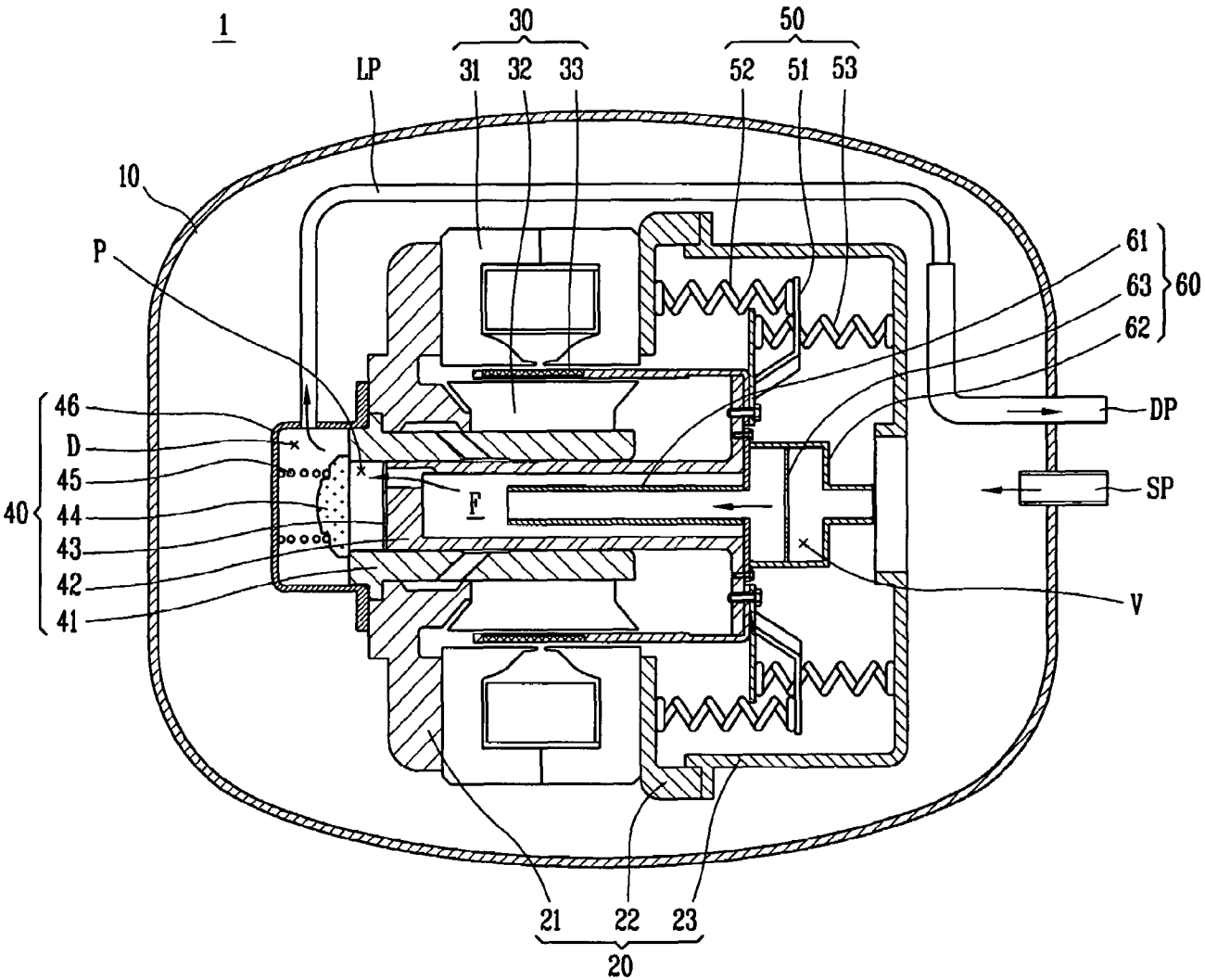
FIG. 1 CONVENTIONAL ART
FIG. 1 is a longitudinal sectional view showing the conventional reciprocating compressor.
Figure 2:
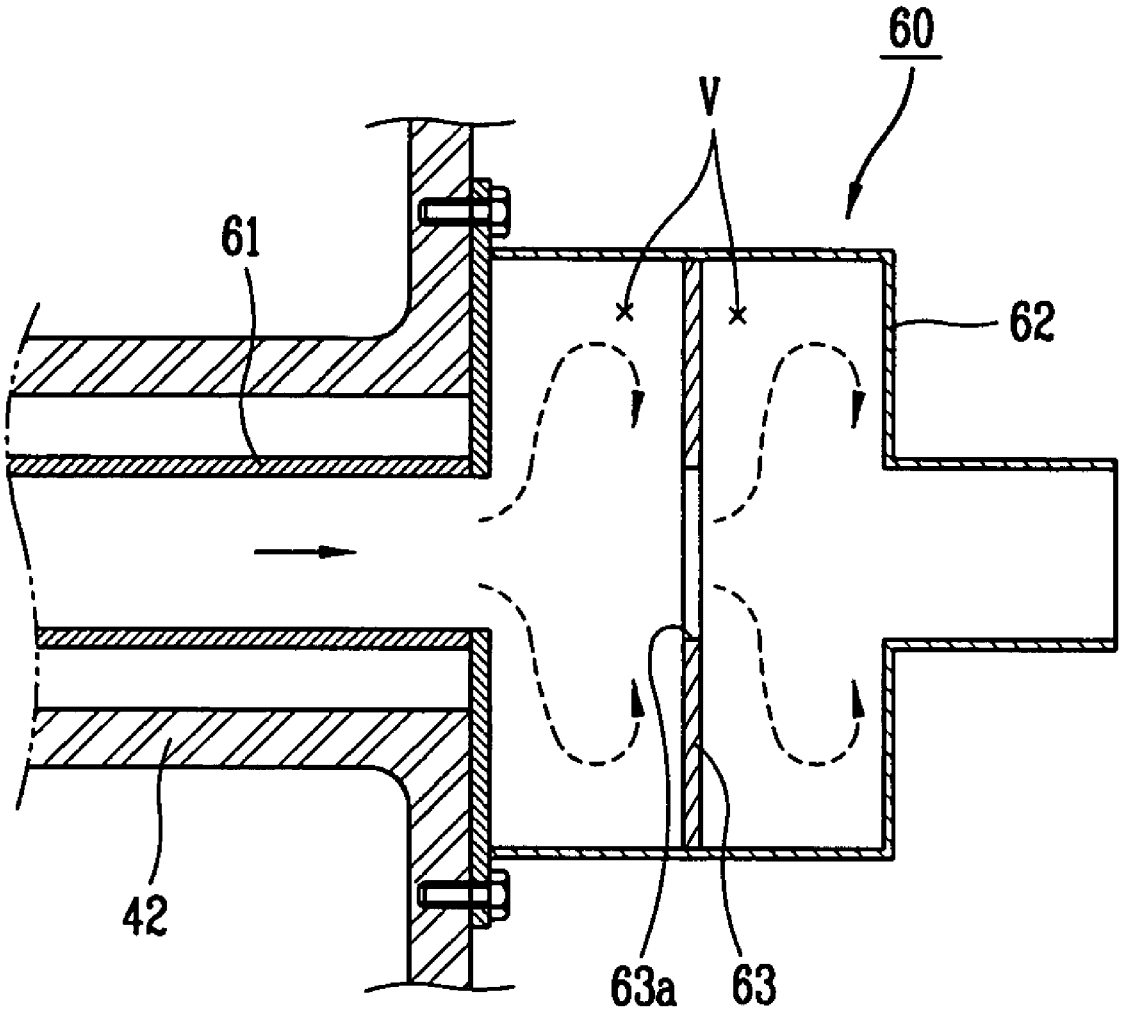
FIG. 2 CONVENTIONAL ART
FIG. 2 is a view showing an important part of FIG. 1.
Figure 3:
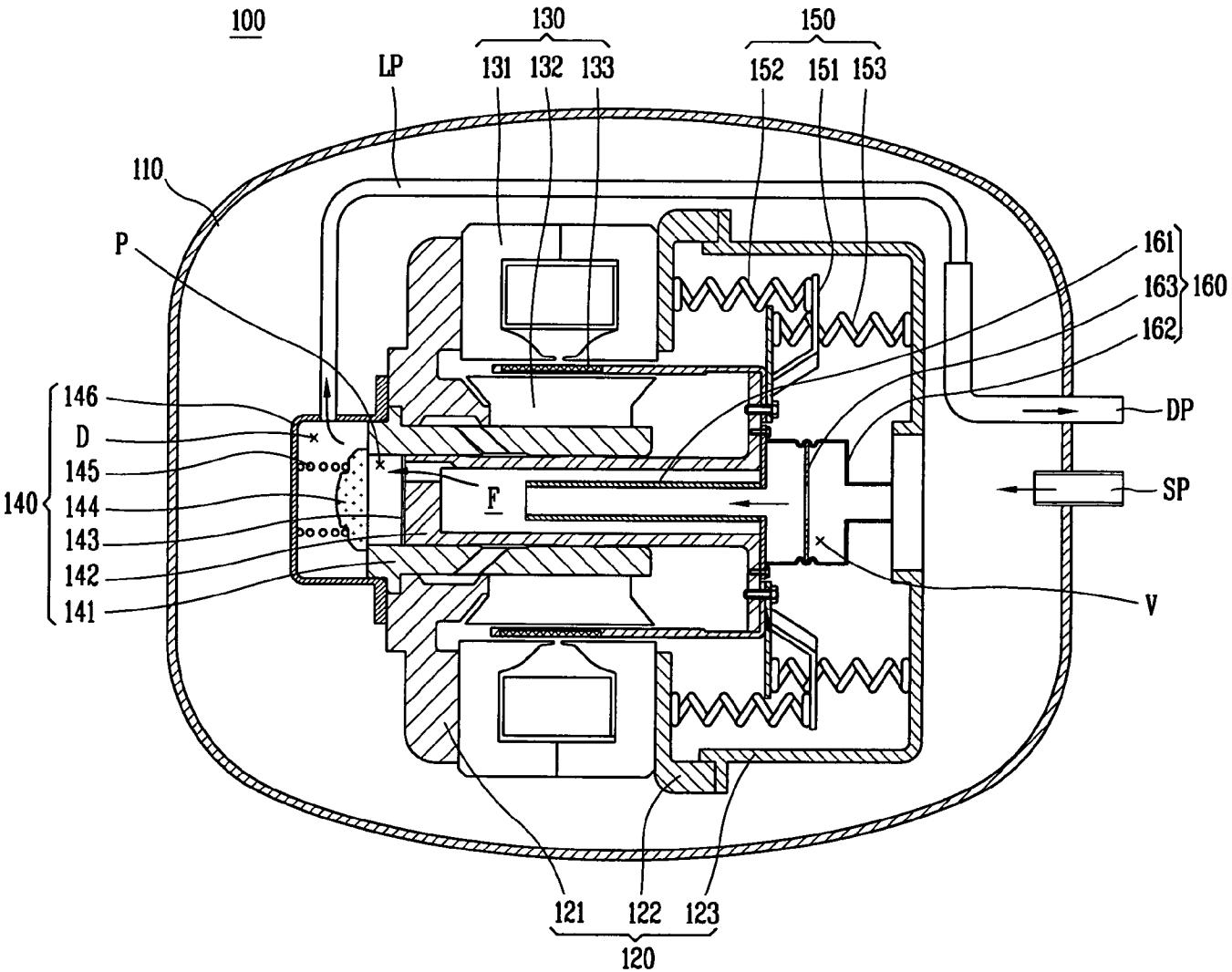
FIG. 3 is a longitudinal sectional view showing a reciprocating compressor in accordance with one embodiment of the present invention.
Figure 4:
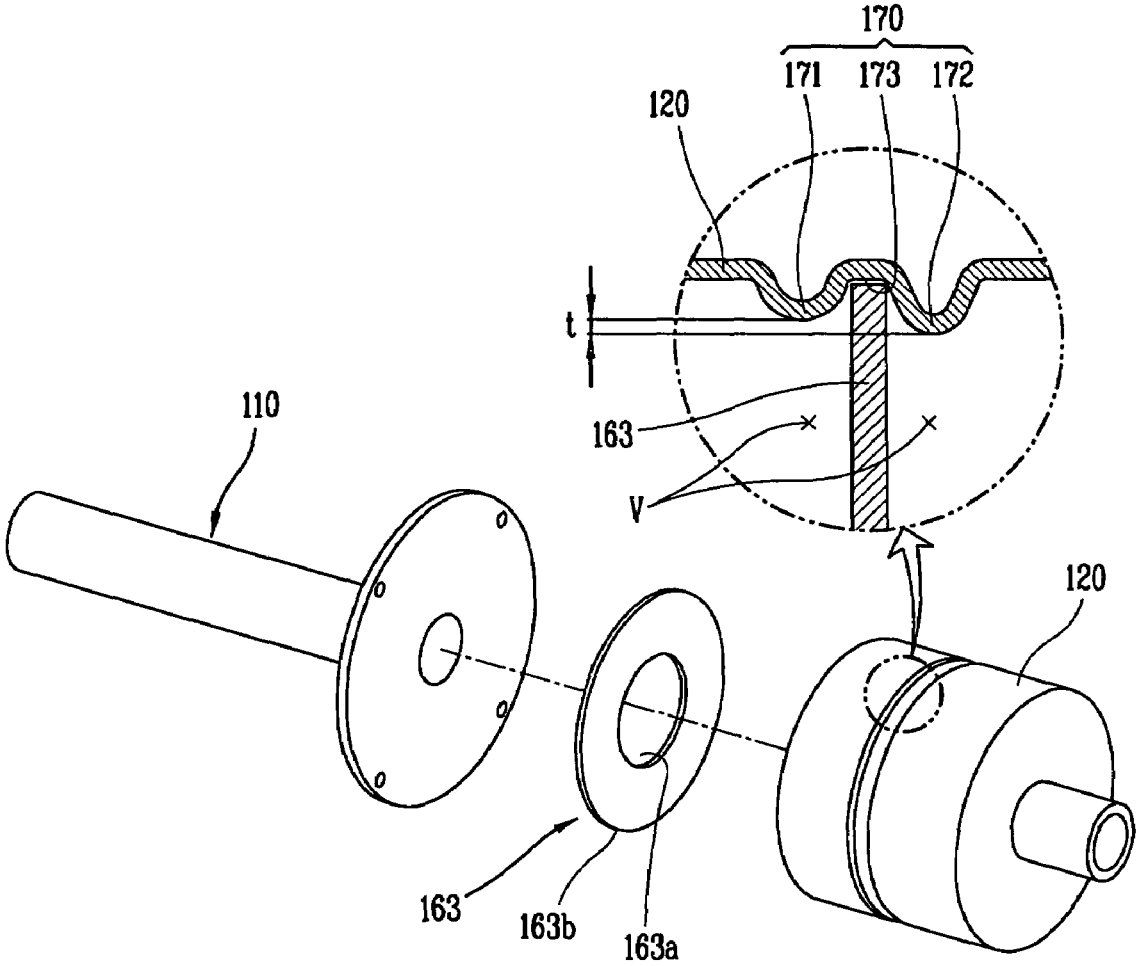
FIG. 4 is a perspective exploded view showing a piston and a suction muffler of the reciprocating motor in accordance with one embodiment of the present invention.
Figure 5:
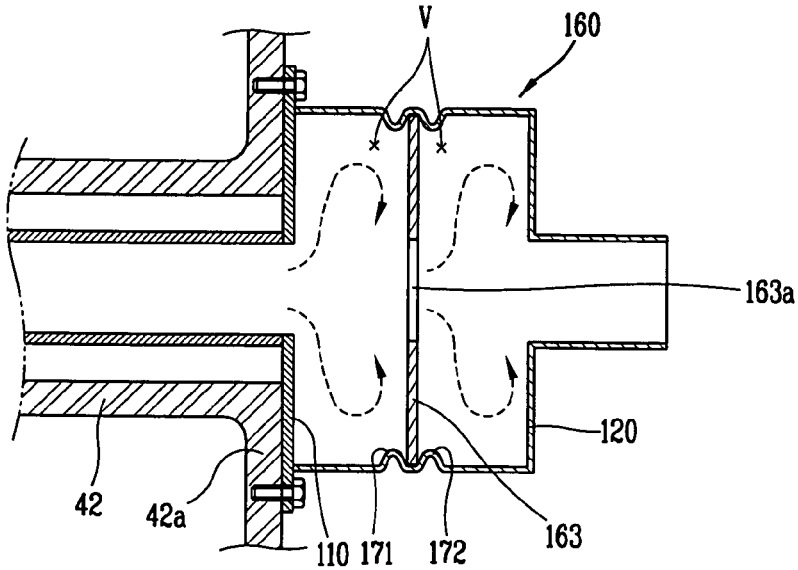
FIG. 5 is a view showing an important part of FIG. 3.

FIG. 3 is a longitudinal sectional view showing a reciprocating compressor in accordance with one embodiment of the present invention, FIG. 4 is a perspective exploded view showing a piston and a suction muffler of the reciprocating motor in accordance with one embodiment of the present invention, and FIG. 5 is a view showing an important part of FIG. 3.

As shown therein, a reciprocating motor 100 having an assembly structure of a suction muffler in accordance with one embodiment of the present invention includes: a casing 110 for communicating a gas suction pipe (SP) with a gas discharge pipe (DP); a frame unit 120 elastically installed in the casing 110; a reciprocating motor 130 supported by the frame unit 120 and installed in the casing 110; a compression unit 140 connected to the reciprocating motor 130 and supported by the frame unit 120; and a resonance spring unit 50 for inducing the resonance movement so as to elastically support the reciprocating motor 130.

The frame unit 120 includes: a front frame 121 for supporting both one side of the reciprocating motor 130 and the compression unit 140; a middle frame 122 coupled with the front frame 121 and supporting the other side of the reciprocating motor 130; and a rear frame 123 coupled with the middle frame 122 and supporting a rear resonance spring 153 to be described later.

The reciprocating motor 130 includes: an outer stator 131 fixedly installed between the front frame 121 and the middle frame 122; an inner stator 132 fixed to the front frame 121, leaving a certain air gap at the inside of the outer stator 131; and a mover 133 interposed between the outer stator 131 and the inner stator 132, coupled with a piston 142 of the compression unit 140, and linearly reciprocating together with the piston 142.

The compression unit 140 includes: a cylinder 141 fixed to the front frame 121; the piston 142 slidingly inserted into the cylinder 141, coupled with the mover 133 of the reciprocating motor 130 and linearly reciprocating; a suction valve 143 formed at a front end surface of the piston 142 and opening or closing a suction flow channel (F); a discharge valve 144 formed at a discharge side of the cylinder 141 and controlling the discharge of a compressed gas by opening or closing a compression space (P); a valve spring 145 for elastically supporting the discharge valve 144; and a discharge cover 146 accommodating the discharge valve 144 and the valve spring 145 and covering the discharge side of the cylinder 141.

The resonance spring unit 150 includes: a spring supporting unit 151 coupled with a connection portion of the mover 133 and the piston 142; and a front resonance spring 152 and a rear resonance spring 153 disposed at front and rear both sides of the spring supporting unit 151 and elastically supporting the mover 1 33 and the piston 142.

A supporting unit 170 is protrudingly formed on an inner circumferential surface of a resonant container 162 of a suction muffler 160. The supporting unit 170 includes a first protrusion 171 and a second eaiilking-protrusion 172, and between the first and second protrusions 171 and 172, an insertion groove 173 is formed along the inner circumferential surface of the resonant container 162. A baffle 163 is inserted into the insertion groove 173 and assembled in the resonant container 162. As shown in FIG. 4, the first protrusion 171 and the second protrusion 172 are formed as a ring shape along the inner circumferential surface of the resonant container 162.

When setting heights of the first protrusion 171 and the second protrusion 172, they are preferably set to be high enough to prevent the baffle 163 from being separated from the insertion groove 173 after an end 163 of the baffle 163 is inserted into the insertion groove 173.

In addition, in order that a user can easily insert the baffle 163 into the insertion groove 173, the first protrusion 171 is lower than the second protrusion 172, preferably by an amount "t",.

Figure 6:
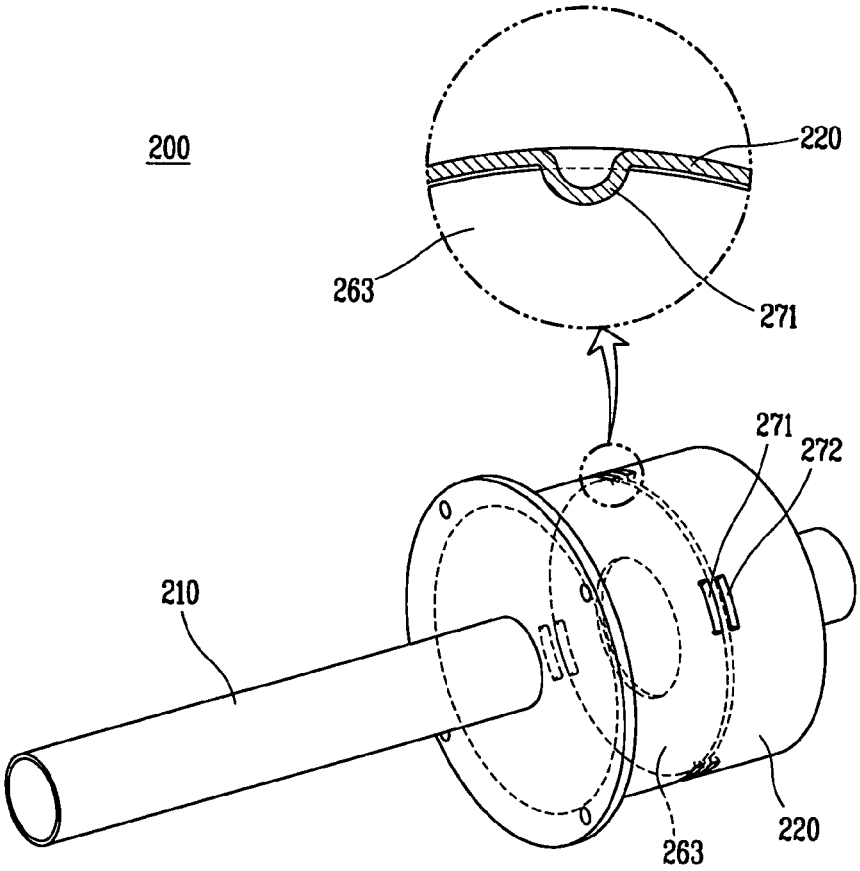
FIG. 6 is a perspective view showing a state in which the piston and the suction muffler are assembled in a reciprocating compressor in accordance with another embodiment of the present invention.

A through hole 163*a* formed to be almost concentric with the guide pipe 110 in the middle of a baffle 163, and therefore the baffle 163 makes a ring shape as a whole Meanwhile, when the baffle 163 is assembled at the inner circumferential surface of the resonant container 120, after the baffle 163 is pushed into the resonant container 162, the end As shown in FIG. 6, in a reciprocating compressor 200 in accordance with another embodiment of the present invention, a first protrusion 271 and a second protrusion 272 are not formed along the inner circumferential surface of a resonant container 220, but a plurality of first protrusions 271 and the second protrusions 272 can be formed at the inner circumferential surface with regular intervals.

A through hole is formed to be almost concentric with a guide pipe 210 in the middle of a baffle 263, and therefore the baffle 263 makes a ring shape as a whole.

Meanwhile, when the baffle 163 is assembled at the inner circumferential surface of the resonant container 120, after the baffle 163 is pushed into the resonant container 162, the end 163b of the baffle 163 goes over the first protrusion 171 and then is inserted into the insertion groove 173, whereby the baffle 163 is firmly assembled in the resonant container 162. By pushing the baffle 163 in the resonant container 162, the end 163b of the baffle 163 is supported by the first saulking-protrusion 171 and the second eaulking-protrusion 172, whereby the baffle 163 is firmly assembled. Accordingly, assembly characteristics can be improved and the noise reduction effect of the suction muffler 160 can be increased.

In the reciprocating compressor in accordance with the present invention, by forming eaulki*gprotrusions in the resonant container and inserting the baffle between the eaulking protrusions, the suction muffler is easily and simply assembled in the resonant container. Accordingly, the reciprocating compressor can not only reduce production costs but also increase the noise reduction effect by regulating a position of assembling the baffle. regulating a position of assembling the baffle.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A reciprocating compressor having an assembly structure of a suction muffler, comprising:

a casing for connecting a gas suction pipe with a gas discharge pipe;

a frame elastically installed in the casing;

a reciprocating motor supported by the frame;

a piston coupled with a mover of the reciprocating motor and compressing a refrigerant gas while linearly reciprocating in a cylinder;

a suction valve for opening or closing a suction flow channel of the piston;

a discharge valve for opening or closing a discharge side of the cylinder;

a plurality of resonance springs for elastically supporting the piston in a direction of motion and inducing the resonance movement; and a suction muffler coupled with the piston and guiding the refrigerant gas to the suction flow channel of the piston and simultaneously muffling a suction noise generated when opening or closing the suction valve, wherein a supporting unit is formed on an inner circumferential surface of a resonant container of the suction muffler and a baffle is supported in the resonant container by the supporting unit, wherein the supporting unit comprises a first protrusion and a second protrusion, and an insertion groove is formed between the first and second protrusions along the inner circumferential surface of the resonant container, and wherein the first protrusion has a setting height lower than a setting height of the second protrusion in order to permit insertion of the baffle past the first protrusion and into the insertion groove.

2. The compressor of claim 1, wherein the first protrusion and the second protrusion are formed as a ring shape along the inner circumferential surface of the resonant container.

3. A reciprocating compressor having an assembly structure of a suction muffler, comprising:

a casing for connecting a gas suction pipe with a gas discharge pipe;

a frame elastically installed in the casing;

a reciprocating motor supported by the frame;

a piston coupled with a mover of the reciprocating motor and compressing a refrigerant gas while linearly reciprocating in a cylinder;

a suction valve for opening or closing a suction flow channel of the piston;

a discharge valve for opening or closing a discharge side of the cylinder;

a plurality of resonance springs for elastically supporting the piston in a direction of motion and inducing the resonance movement; and a suction muffler couppled with the piston and guiding the refrigerant gas to the suction flow channel of the piston and simultaneously sucking a suction noise generated when opening or closing the suction valve, wherein a supporting unit is formed on an inner circumferential surface of a resonant container of the suction muffler and a baffle is supported in the resonant container by the supporting unit, wherein the supporting unit comprises a first protrusion and a second protrusion, and an insertion groove is formed between the first and second protrusions along the inner circumferential surface of the resonant container, and wherein a plurality of first protrusions and second protrusions are formed at the inner circumferential surface of the resonant container.

4. The compressor of claim 3, wherein the first protrusions and the second protrusions are arranged at regular intervals.

5. A suction muffler for a reciprocating compressor, comprising:

a supporting unit located on an inner circumferential surface of a resonant container of the suction muffler; and a baffle supported in the resonant container by the supporting units, wherein the supporting unit comprises a first protrusion and a second protrusion, and an insertion groove is formed between the first and second protrusions along the inner circumferential surface of the resonant container, and wherein the first protrusion has a setting height lower than a setting height of the second protrusion in order to permit insertion of the baffle past the first protrusion and into the insertion groove.

6. The suction muffler of claim 5 wherein the first protrusion and the second protrusion are formed as a ring shape along the inner circumferential surface of the resonant container.

7. A suction muffler for a reciprocating compressor, comprising:

a supporting unit located on an inner circumferential surface of a resonant container of the suction muffler; and a baffle supported in the resonant container by the supporting unit, wherein the supporting unit comprises a first protrusion and a second protrusiom. and an insertion groove is formed between the first and second protrusions along the inner circumferential surface of the resonant container, and wherein a plurality of the first protrusions and the second protrusions are formed at the inner circumferential surface of the resonant container.

8. The suction muffler of claim 7, wherein the first protrusions and the second protrusions are arranged at regular intervals.

* * * * *